US007722506B2

(12) United States Patent
Pratson et al.

(10) Patent No.: US 7,722,506 B2
(45) Date of Patent: May 25, 2010

(54) EXERCISE DEVICE

(75) Inventors: David C. Pratson, Bonsall, CA (US); Axel Mnich, Oceanside, CA (US); Tien Le, Vista, CA (US); John Cole, San Diego, CA (US)

(73) Assignee: iStep Global, LLC, Encinitas, CA (US)

( * ) Notice: Subject to any disclaimer, the term of this patent is extended or adjusted under 35 U.S.C. 154(b) by 103 days.

(21) Appl. No.: 12/075,322

(22) Filed: Mar. 10, 2008

(65) Prior Publication Data

US 2008/0220944 A1 Sep. 11, 2008

Related U.S. Application Data

(60) Provisional application No. 60/905,969, filed on Mar. 10, 2007.

(51) Int. Cl.
*A63B 22/04* (2006.01)

(52) U.S. Cl. ..... 482/52; 482/77; 273/458

(58) Field of Classification Search ..... 482/26, 482/27, 51, 52, 77, 112, 127, 128, 137, 140, 482/142, 145, 146, 148; 601/23; 273/449, 273/457, 458

See application file for complete search history.

(56) References Cited

U.S. PATENT DOCUMENTS

| | | | | | |
|---|---|---|---|---|---|
| 2,761,155 | A | * | 9/1956 | Headley | 441/40 |
| 2,978,243 | A | * | 4/1961 | Gabrielson | 472/14 |
| 3,095,947 | A | | 7/1963 | Beaulaurier | |
| 3,167,312 | A | * | 1/1965 | Blanchard | 482/128 |
| 3,761,083 | A | | 9/1973 | Buchner et al. | |
| 4,159,826 | A | * | 7/1979 | Hancock | 482/26 |
| 4,516,767 | A | | 5/1985 | Eskijian | |
| 4,516,768 | A | * | 5/1985 | Gallaro | 482/26 |
| 4,817,950 | A | * | 4/1989 | Goo | 463/36 |
| 5,112,045 | A | * | 5/1992 | Mason et al. | 482/9 |
| 5,441,466 | A | | 8/1995 | Piaget et al. | |
| 5,575,738 | A | | 11/1996 | Millington et al. | |
| 5,637,057 | A | | 6/1997 | Collura | |
| 5,813,946 | A | | 9/1998 | Lin et al. | |
| 6,015,471 | A | | 1/2000 | Rimington et al. | |
| 6,575,885 | B1 | | 6/2003 | Weck et al. | |
| 6,659,914 | B2 | | 12/2003 | Plante | |
| D489,423 | S | | 5/2004 | Fan et al. | |
| 2004/0023766 | A1 | | 2/2004 | Slone | |
| 2005/0049123 | A1 | | 3/2005 | Dalebout et al. | |
| 2005/0148433 | A1 | | 7/2005 | Wang et al. | |
| 2007/0066461 | A1 | * | 3/2007 | Carter et al. | 482/140 |

* cited by examiner

*Primary Examiner*—Loan H Thanh
*Assistant Examiner*—Tam Nguyen
(74) *Attorney, Agent, or Firm*—Charles F. Reidelbach, Jr.

(57) ABSTRACT

An exercise for step aerobics, games, and proprioceptive input training. The device features a rigid platform supported by a resilient inflated tubular sidewall. The sidewall may be of a single tube or a plurality of tubular members engaged on top of each other. Inflation pressure of said sidewall provides an adjustment of the resilience thereby adjusting instability of the platform in the horizontal and vertical directions. Instability in the vertical direction provides a cushioning to users in a step aerobics exercise while instability in both direction provides a manner for a user moving or exercising on the platform to obtain proprioceptive input training.

13 Claims, 5 Drawing Sheets

EXERCISE DEVICE

This application claims the benefit of U.S. Provisional application 60/905,969 filed Mar. 10, 2007, and which is entirely incorporated herein by reference.

FIELD OF THE INVENTION

The disclosed device relates to exercise equipment. More particularly, it relates to an apparatus providing an elevated platform for step aerobics or exercising which employs resilient tubes for a reduced impact to the user. Concurrently the device provides a platform on which balance may be practiced to increase a user's proprioception along with provisions for the employment of and elastic resistance band for strength training. The device may be employed for aerobics, step aerobics, weight training with dumbbells, abdominal workouts, balance training, plyometric exercises, karate training, playing combat games and competitions, and muscle development with disabled children.

BACKGROUND OF THE INVENTION

Step aerobics is a form of aerobic exercise ever more popular with athletes and amateurs alike. As an exercise it is distinguished from other forms of aerobic exercise by its use of an elevated platform (the step). The height of the step may be tailored to individual taste by inserting risers under the step. Step aerobics classes are offered at many gyms and fitness centers which have a group exercise program. Such step-type exercisers have come to be a popular form of exercise in which the user continuously steps up upon, and off of, a substantially rigid platform. The constant up and down exercise strengthens different leg muscle groups using simple gravity and the user's own weight.

Proprioception is the sense of the relative position of neighboring parts of the body. Unlike senses such as sight and balance by which we perceive the outside world, proprioception is distinct sense that communicates feedback to the user solely on the status of their body internally. It is the sense that indicates whether the body is moving as well as where the various parts of the body are located in relation to each other. It is this sense of proprioception which allows someone to learn to walk in complete darkness without losing balance since they are aware of where their feet, body and the ground are located relative to each other, without having to see them. Without the brain having constant proprioceptive input, it would be impossible, for example, for a person to walk without watching where they put their feet.

This proprioceptive sense can be sharpened through exercises and such is sought by athletes as well as injured people during rehabilitation. For instance, juggling trains the mind for reaction time, spatial location, and efficient movement. Frequently, standing on a wobbly board or balance board is an exercise employed to re-train or increase proprioception abilities, and also particularly as physical therapy for ankle or knee injuries.

However there is no current exercise or balance device which provides both a cushioning effect during step exercising, and an elevated substantially rigid platform which will provide actual unexpected lateral and vertical movement to the user during use, to thereby provide a means for the user to practice their balance for proprioceptive input training. Neither does such a device exist that will allow users to play balance games with adjacently positioned similarly configured resilient devices.

The elastic resistance band is a portable alternative to weights for strength training. A variety of exercises have been devised to target specific muscle groups. Resistance band exercises are widely used by a variety of health and fitness practitioners—both for general strength and conditioning and rehabilitation or injury prevention. However, currently most such resistance band devices must be connected to a heavy mount to the wall or floor, or are placed under the user's foot while in use which can cause problems or injuries should it slip during an exercise. No step exercisers provide a combination step aerobic device that is adapted to engage an elastic resistance band for use while atop the step exerciser nor any such combination that also allows the user to employ the resistance band for exercisers atop the step exerciser which moves side to side for training to increase or rehabilitate proprioception.

U.S. Pat. No. 3,095,947, Beaulaurier teaches an elevated trampoline. However the device as taught employs a flexible platform laced to the top of the annular tubes which will bend or deflect when stood upon to act as a trampoline. It is ill equipped to provide for a step exerciser or a rigid elevated platform to allow for balance training.

U.S. Pat. No. 4,516,768 to Gallaro teaches a rigid platform; however, the platform is supported upon the peak of the exterior surface of a single tube bladder. The Gallaro device thus lacks any interaction between inline tube bladders to aid in balance exercises and an easy means for engagement of the platform to the device which does not employ straps.

U.S. Pat. No. 6,659,914 (Plante) depicts an inflatable tube exercise device. However, Plante employs the conventional lacing of a flexible platform to the tube, and only a single tube bladder. Thus there is no interaction between stacked tube bladders and the platform is flexible and hard to engage.

U.S. Pat. No. 4,159,826 (Hancock) teaches an elevated platform supported on an inflatable structure for jogging exercise. However the Hancock device employs a polypropylene or other flexible fabric planar surface for the user to stand upon which is laced to the single tube bladder. It is ill equipped for step exercising and lacks the tube bladder interaction to provide concurrent balance exercising.

U.S. Publication No. 2005/0148433 (Wang et al.) discloses an elevated platform supported by a tubular member. However Wang employs a flexible support surface as it is a water trampoline and has no second engaged tubular member for interaction and balance exercises.

U.S. Pat. No. 5,637,057 (Collura) teaches a tire trampoline platform having a plurality of openings installed for purposes of blowing air from an inner cavity of the tires onto a person jumping on the platform. The Collura device is essentially a bellows with the stated object of pumping air onto a user jumping on it and is inhibited by the fact that it employs old tires which by their nature are designed with belts and cords to prevent sway and do not have sealed inner cavities that allow for adjustment of resilience.

As such, there exists a need for a device that provides a substantially rigid support surface engaged to a tubular member which will allow for step exercising to the support surface. Such a device should provide an easy and secure means for engagement of the support surface to the resilient tubular member to insure a secure mount during swaying and other motion during use. Such a device should employ a pair of tubular members with sealed inner cavities so that the tubular members will interact with each other to tilt and to sway the platform when the user moves thereon, to thereby provide balance exercise and a means to practice or re-train a user in proprioception. Still further, such a device should employ means to maintain it in place on slippery linoleum and interior surfaces during use, and should preferably provide for the use of elastic resistance band devices while a user is thereon to allow for exercise of muscle groups while concurrently providing cushioning to the user and sway and balance to increase proprioception.

With respect to the above, before explaining at least one preferred embodiment of the invention in detail, it is to be understood that the invention is not limited in its application to the details of construction and to the arrangement of the components or steps set forth in the following description or illustrated in the drawings. The various apparatus and methods of the invention are capable of other embodiments and of being practiced and carried out in various ways which will be obvious to those skilled in the art once they review this disclosure. Also, it is to be understood that the phraseology and terminology employed herein are for the purpose of description and should not be regarded as limiting.

As such, those skilled in the art will appreciate that the conception upon which this disclosure is based may readily be utilized as a basis for designing of other devices, methods and systems for carrying out the several purposes of the present disclosed device for step exercising and balance practice and elevated games. It is important, therefore, that the objects and claims be regarded as including such equivalent construction and methodology insofar as they do not depart from the spirit and scope of the present invention.

SUMMARY OF THE INVENTION

The disclosed device provides a step exerciser for step aerobics while also providing a substantially rigid deck which moves in a fashion to absorb the shock user impact as well as having motion qualities allowing for proprioception training and rehabilitation. The device features a first circular tubular member having a sealed internal cavity that is air-filled for adjustable resilience and which tubular member is also adapted for a non-slip positioning upon the ground or other surface. This is preferred since moisture on a smooth surface such as vinyl flooring can be very slippery.

While the device may be employed with only one, or the first tubular member engaged to the substantially rigid deck, in the preferred mode of the device, a second air-filled tubular member is engaged to the top surface of the first tubular member. In an especially preferred mode of the device, this means of engagement is a tongue and groove engagement which provides a flexible yet firm engagement of the overhead second tubular member to the first tubular member. Also preferred is the first or lower tubular member having a larger diameter than the engaged overhead second tubular member.

The employment of means of engagement of the upper second tubular member to the lower first tubular member allows for the device to be dissembled and the components including the separable tubular to be shipped in smaller, easier to handle pieces, rather than one large one. Of course, other means to engage the two tubular members as would occur to those skilled in the art can be employed and such is anticipated; however, in the current preferred mode, the tongue and grove engagement is preferred as it provides a very good connection between both resilient members during horizontal movement and vertical compression which does not interfere with the swaying movements since the connection itself is resilient. In a mode of the device with less utility, the two tubular members may be permanently attached to each other, or formed as a unitary structure. If formed as a unitary structure, the two tubular members would have separate sealed internal cavities; however, they would not be separable for shipping and storage.

Engaged upon the top or upper end of the second tubular member is a flat, wood or plastic substantially rigid planar surface consisting of a platform of unitary construction or with an underlying support on which the user stands during balance practice or on which the user employs the elastic resistance device. For step aerobics and similar exercises the user steps upon and steps off the planar surface providing the deck during stepping or climbing exercised. The planar surface also serves as a position on which the user may stand during games such as battling other users on adjacent devices in games.

Means for engagement of the planar surface to the upper tubular member employs a unique sandwiching engagement of a flexible annular member engaged adjacent to the top surface of the second tubular member between a lower ring and an upper ring member that provides the support for the upper deck. The flexible annular member being made of the same material as the upper tubular member will stretch and sway with the upper tubular member. The sandwiched engagement is maintained by means of engagement of the lower ring to the upper ring which currently employs a snap-in engagement for a surface of the lower ring with the upper ring. While those skilled in the art will ascertain that other means of engagement of the planar surface to the upper tubular member may be used and such is anticipated, the current employment of the flexible annular between the snap-together upper and lower rings works especially well and allows for sway and compression of the tubular members without dismount of the planar upper surface and with little effect on the sway motion which other mounts may inhibit.

Another means of engagement of the planar surface to the upper tubular member is a projecting edge extending from the exterior perimeter of the planar surface which engages under a flexible edge of a recess on the top surface of the upper tubular member. This allows for the planar surface to be easily engaged within the recess formed in the top surface of the upper of the two tubular members in a very secure mount and avoids the inherent problems of lacing and conventional means for engaging such platforms.

The construction of the device, by overlaying two tubular members formed of flexible sidewalls, yields unique functions and movement. Such movement is provided by a combination of the air filled tubular members, the circular nature of their shape, and the tongue and groove engagement forming an engaged seam in-between the two independent tubular members. With this combination of components, when a user leans off balance while standing on the platform, more weight is imparted to one side of the platform and to the engaged tubular member on that side.

The extra weight on one side and lesser amount on the other side of the platform, causes a horizontal or sideways motion, combined with an up and down or vertical motion from tube compression, when a user stands on the platform, moves on the platform, or steps off the platform. As noted, the sidewall formed by the two tubes will collapse a bit under the user's weight, and concurrently, the top tube and bottom tube at their intersection at a seam, tend to rotate at their communicating seam formed by the tongue and groove or other means for locked engagement. This rotation is generally toward the center of the device on a side where the user puts the most weight providing an unstable platform on which to practice or play.

In the preferred embodiment of the device the lower tubular member is of a slightly larger diameter than the upper tubular member which allows for lateral movement as well as vertical movement of the platform in use. In this mode though the vertical movement tends to rotate the lower tube toward the center of the device making it more stable than if the two tubes are of the same diameter which causes more of a bounce. It also gives the device a larger footprint on the floor or support surface to help avoid slipping when stepping up and provides a short step on the lower tubular member if desired. Additional means for frictional engagement to the support surface is provided by a plurality of ridges extending from the bottom surface of the lower tubular member of the pair which help maintain a slip-free engagement on the floor or support surface, even if wet.

Finally, as noted, both the tubular members are air-filled to maintain their shape. The employment of two such tubular members allows for inflation of each at different levels which provides a means to impart further unstableness to the device and adjust it as desired by changing the relative pressures of the two tubular members.

As noted, the device may be employed as a step exercise device, or a balance practice device, or the device can be employed as a game, for king of the hill in the singular mode, or, when two or more devices are placed adjacent, different players standing on each device so situated can try to knock the other off their respective platforms using their hands, arms, or combat sticks or members. Further, mounts for engagement of elastic resistance band exercise devices to the platform allow use of the elastic resistance device while being supported on the platform. This allows the user to employ their elastic resistance device to condition their cardiovascular system as well as strengthen specific muscle groups and concurrently allows the user to engage in proprioception training and rehabilitation by simply using the elastic resistance component while on top of the platform.

It is thus an object of the invention to provide a device for step exercising with reduced impact.

It is a further object of this invention to provide a device for balance practice for the user to engage in proprioception training and rehabilitation.

It is another object of this invention to provide a device having a mount for an elastic resistance component on the platform to allow use thereof while occupying the platform for cardiovascular exercise and increasing the proprioception training level.

An additional object of this invention is the provision of a device that will allow for balance games between multiple users on multiple platforms.

Yet another object of this invention is the provision of such a device which will provide an easy means for engagement of a substantially rigid platform to the top surface of a tubular member.

These together with other objects and advantages which will become subsequently apparent reside in the details of the construction and method as more fully hereinafter described and claimed, reference being had to the accompanying drawings forming a part thereof, wherein like numerals refer to like parts throughout.

DETAILED DESCRIPTION OF THE PREFERRED EMBODIMENTS

Figure 1:
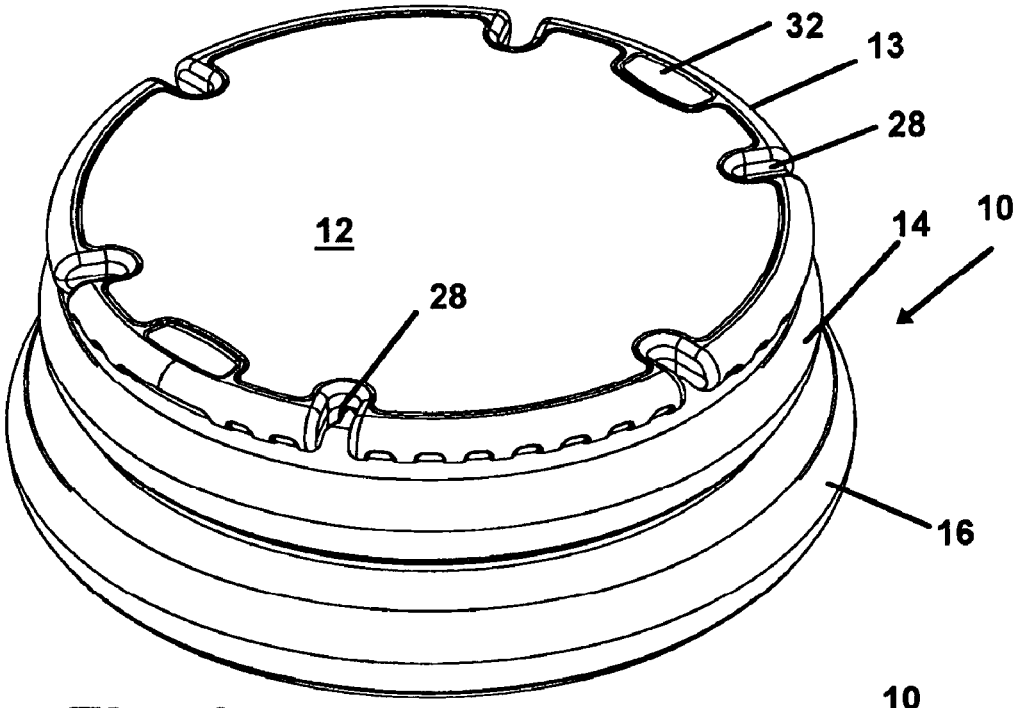
FIG. 1 depicts a perspective view of the device showing the first tubular member engaged upon the top surface of a lower second tubular member and a substantially rigid platform engaged to a top surface of the upper tubular member.
Figure 8:
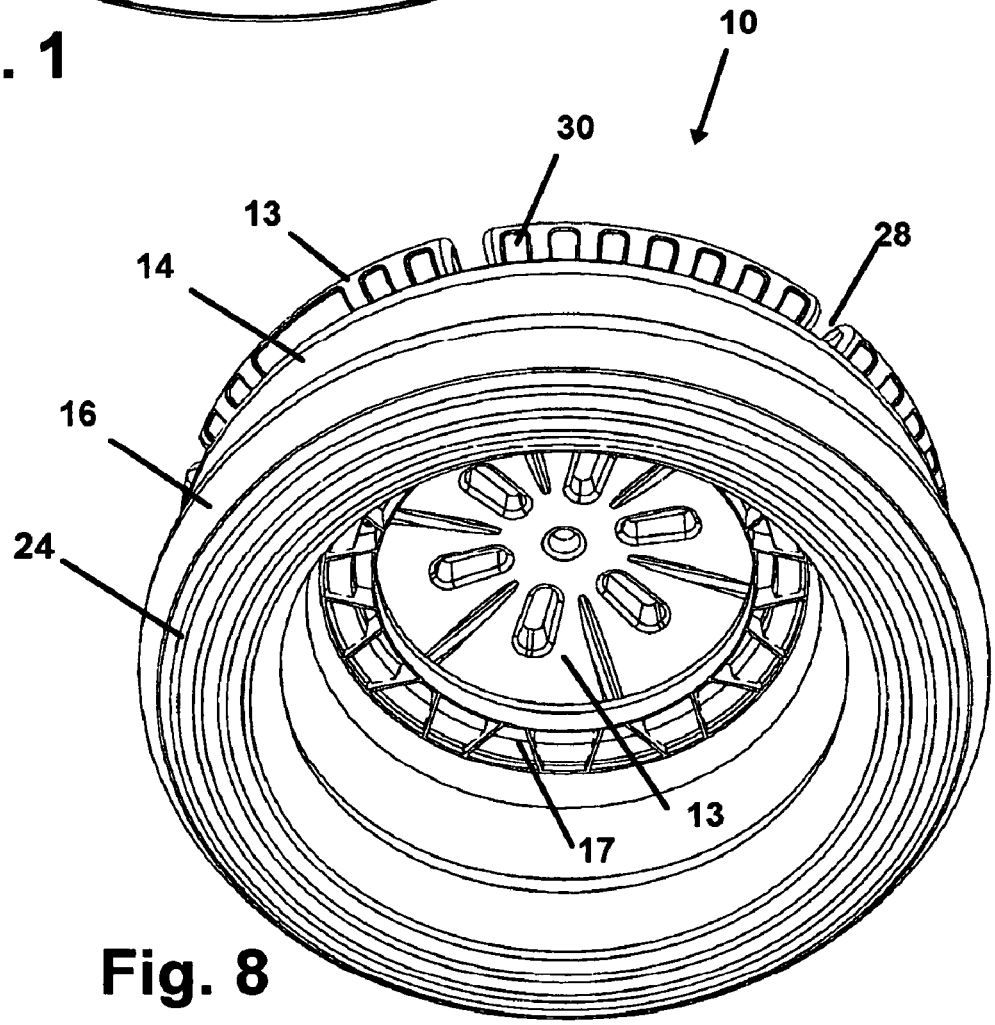
FIG. 8 depicts a bottom perspective view of the device.
Figure 2:
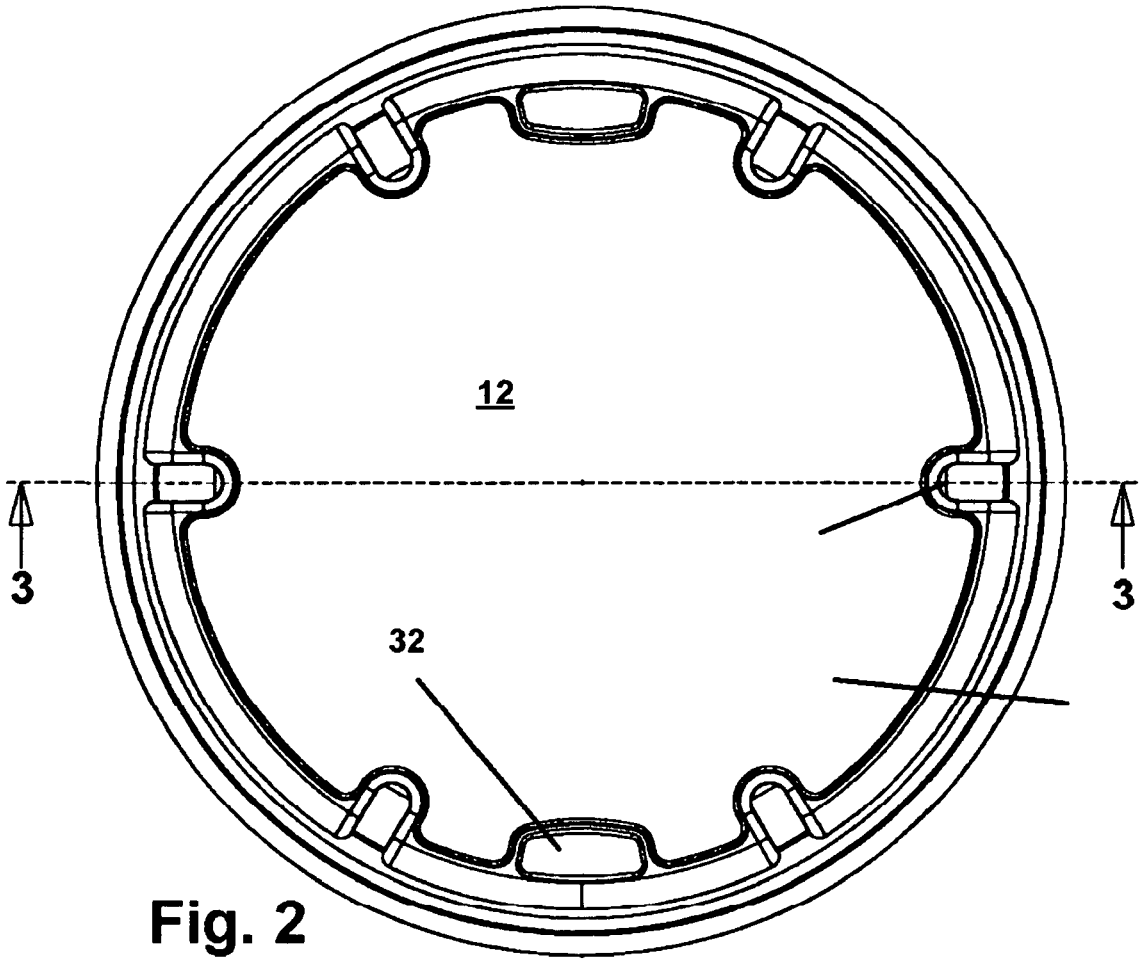
FIG. 2 is a top plan view showing the platform engaged to the smaller upper tubular member and handles and resistance band exercise mounts on the platform circumference.

As seen in FIGS. 1-7 wherein similar parts are identified by like reference numerals and may be found in one or more of the drawings, a platform 12 is engaged to an underlying substantially rigid platform support 13. This engagement can be seen in FIGS. 3-4 and also in FIG. 7 which shows the exploded view of the various components of the preferred mode of the device 10.

Figure 5:
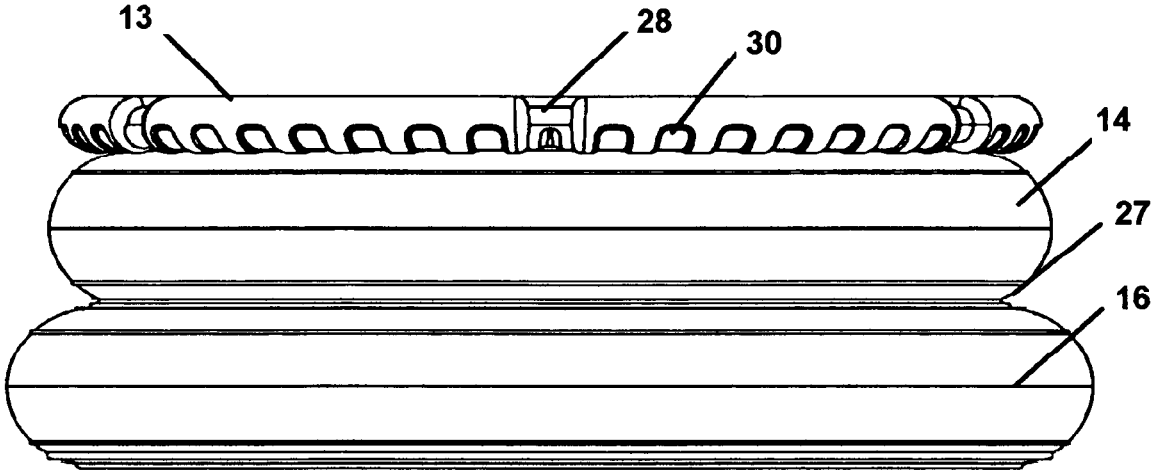
FIG. 5 is a side view of the device showing the larger diameter lower tubular member supporting the smaller upper tubular member and the platform support having mounts for a resistance band exercise device adjacent to a plurality of air vents.
Figure 6:
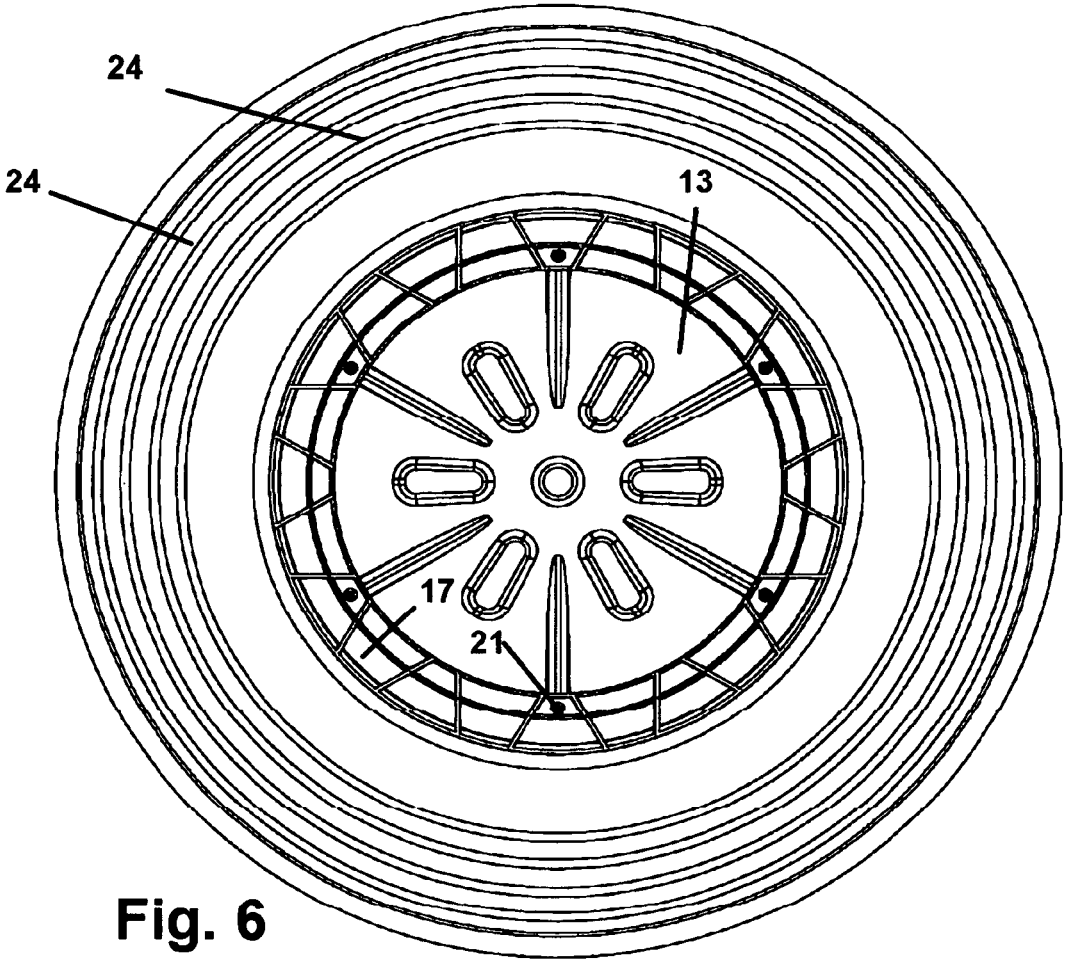
FIG. 6 depicts a bottom view of the device showing the bottom of the support surface engaged with the lower ring and a plurality of engagement points between the two. Also shown are the projections from the bottom surface of the lower tubular member.
Figure 7:
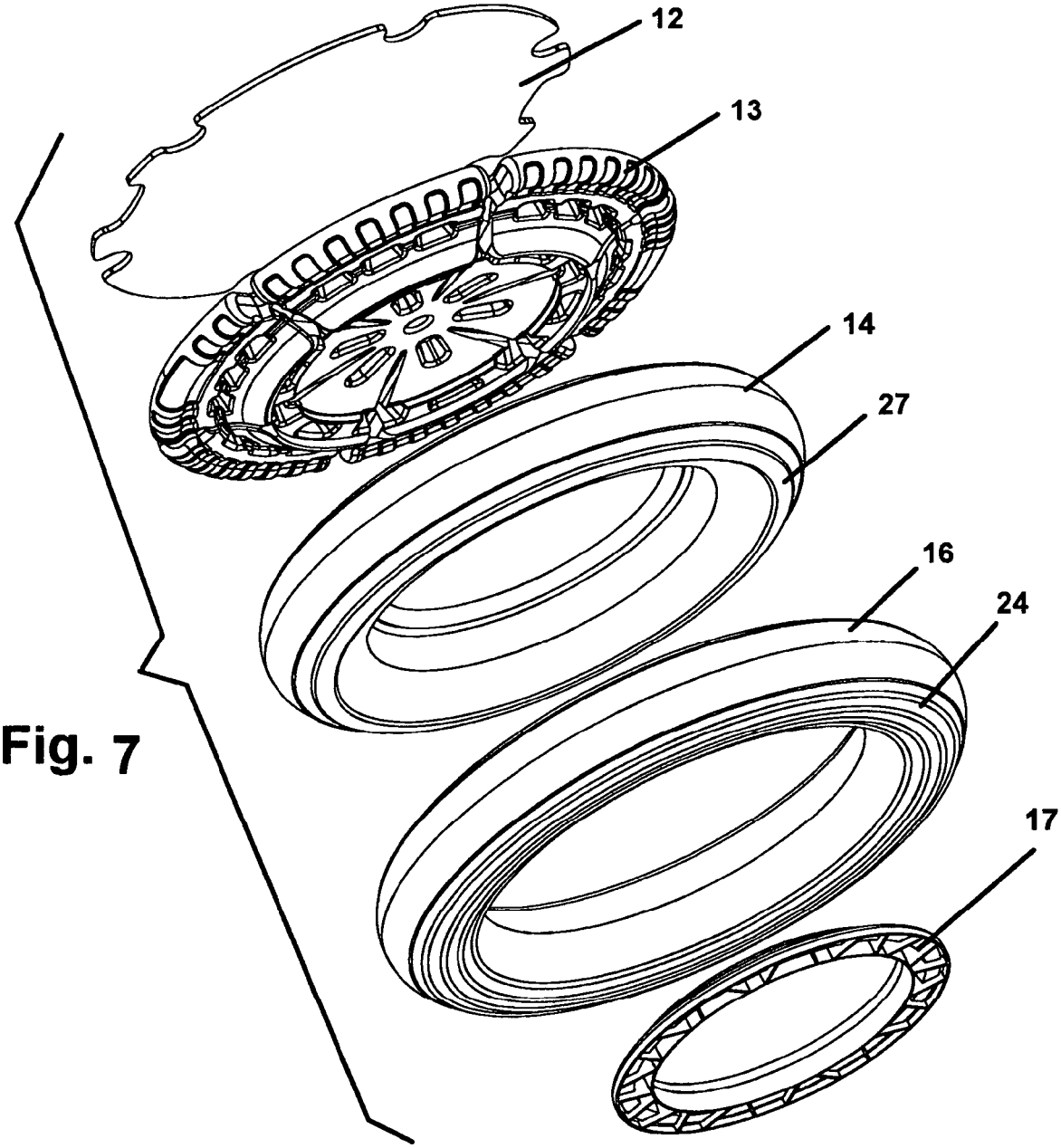
FIG. 7 is an exploded view of the device showing the components thereof in the preferred mode.

As depicted in FIGS. 1 and 5, a platform 12 is held in an elevated position adjacent to the upper end of a sidewall formed of an upper tubular member 14 and lower tubular member 16. Both tubular members have sealed interior cavities 26 formed by surrounding sidewalls formed of elastic material such as rubber, polypropylene, polyethylene, or other polymers adapted to the task. The tubular members are inflated (using a valve stem, not shown) and the flexible and compressible nature of the inflated tubular members 14 and 16 having elastic walls, renders the platform 12 unstable for both lateral and vertical movement by a user moving in a position on top of the platform 12.

Figure 3:
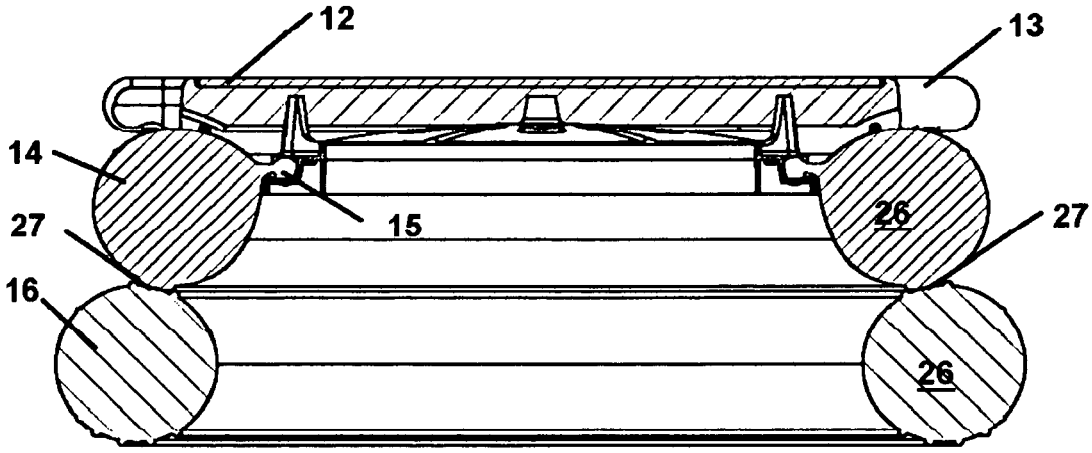
FIG. 3 is a slice through FIG. 2 showing the independent tubes forming the circular sidewall and the lip or tongue and groove engagement of the top surface of the lower tubular member to the bottom surface of the upper tubular member and the flexible annular ring portion of the top tubular member sandwiched between the platform support and a lower ring.

As can be discerned from the sliced views of FIG. 3 the two tubular members 14 and 16 formed of elastic material, combine to form a sidewall supporting the platform 12, which is flexible when filled with air yielding a resilience to the sidewall. The sidewall so formed will collapse a bit under the user's weight, especially when that weight is imparted to the platform 12 off balance and will also tend to slide horizontally due to motions by the user. Both the vertical and horizontal movement are impacted by the resilience of the formed sidewall formed by the tubular members 14 and 16. Changing the air pressure inside the interior cavities 26 of either or both tubular members 14 and 16 provides a means to change the resilience of the sidewall and thus a means to change the reactive horizontal and vertical movement of the attached platform 12 relative to the user movement thereon.

The platform 12 being supported across its planar surface by the underlying platform support 13 may also be substantially rigid or may be a compressible material for cushioning if so desired. This two component surface is preferred because the platform 12 may be replaced or of a different material than the platform support 13 however the device would simply employ a unitary or single piece platform 12 having the components of the aforementioned two parts in a single unit.

Figure 4:
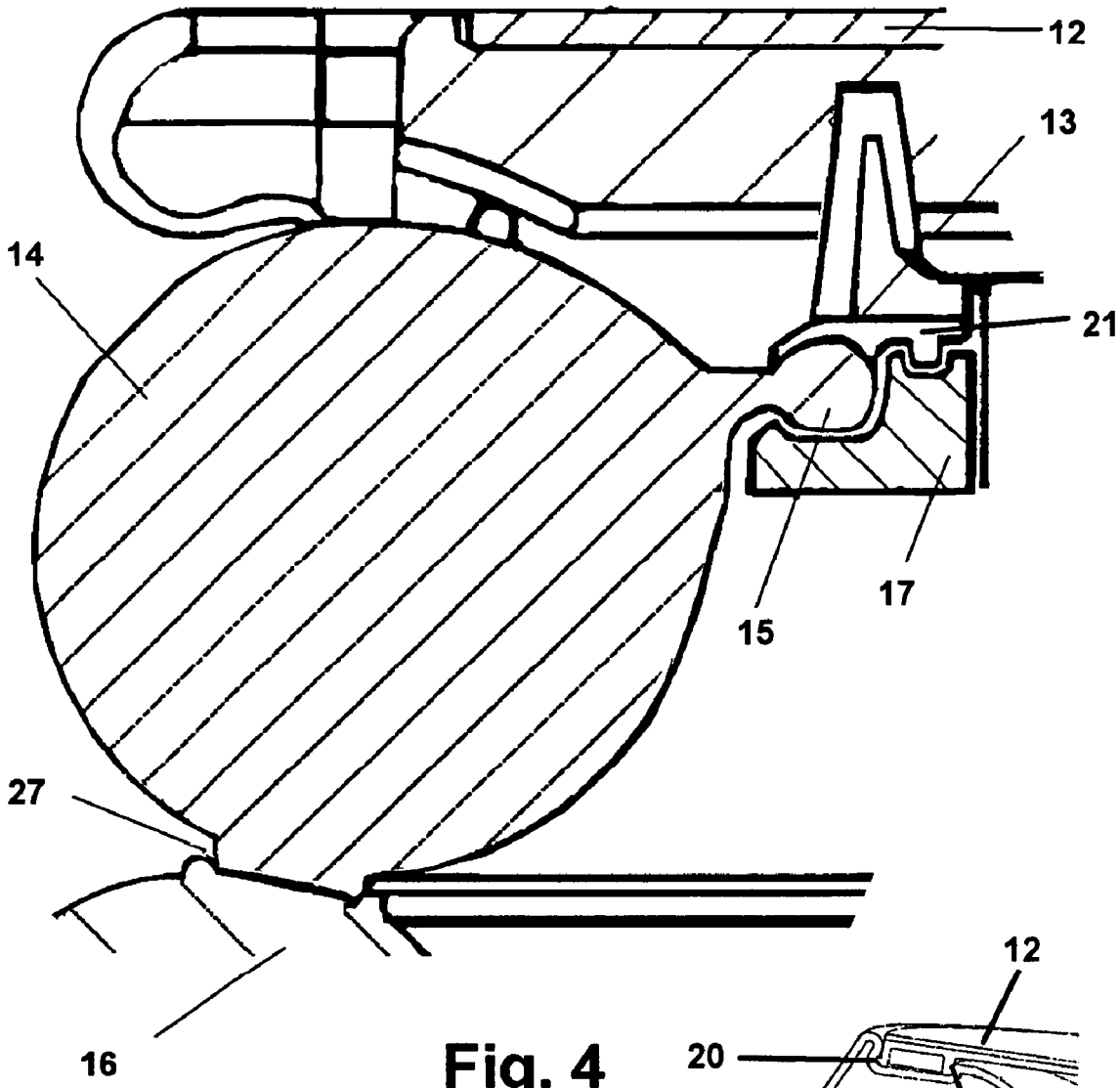
FIG. 4 depicts a close up view of the tongue and groove engagement between the upper and lower tubular members, and the sandwiched engagement of the flexible annular member between the platform support and lower ring.

As shown in FIGS. 3-4, a novel means for engagement of the platform support 13 to upper tubular member 14 is provided by a flexible annular member 15 connected to or formed as part of the upper tubular member 14 about its inside circumference. The annular member 15 is connected in a sandwiched engagement between the bottom surface of the platform support 13 and a ring 17. This engagement is shown in FIG. 4 where the ring 17 is shown with a slot formed therein to engage the annular member 15.

The ring 17 is connected to the platform support 13 with a snap-in engagement 21 or other means of engagement of the ring 17 to the platform support 13 such as a bolt. The annular ring 15 being formed integral with the wall of the upper tubular member 14 provides a very secure mount for the platform support 13 and platform 12 to keep it from dismounting during vertical or sideways motions which would otherwise dismount the rigid support. The annular member 15 also allows for flex since it is elastic or resilient like the upper tubular member 14. This resilience allows the platform support 13 and platform 12 of the device 10 to sway and vertically translate during use without impacting that motion since the annular member 15 will stretch to accommodate the rigid platform support 13 during such movement which is why is employed in the preferred mode of the device 10.

Figure 4A:
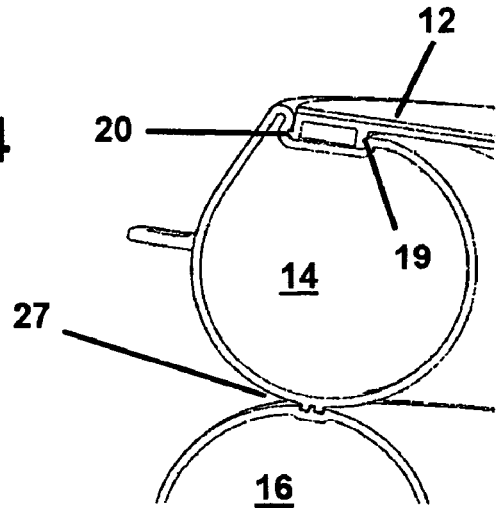
FIG. 4*a* depicts another means for engagement of the platform support to the upper surface of the upper tubular member and a second tongue and groove engagement of the upper and lower tubular members.

Another means of engagement of the planar support surface provided by the platform support 13 and platform 12 to the upper tubular member 14 is shown in FIG. 4*a*. In this mode, projection 19 extending from the exterior perimeter of the platform support 13 engages with a recess 20 on the top surface of the upper tubular member 14 in the pair of engaged tubular members forming the sidewall of the device 10. This mode of the device also allows for the platform to be easily engaged in a very secure mount and avoids the inherent problems of lacing and conventional means for engaging such platforms.

In a preferred embodiment of the device 10 the lower tubular member 16 is of a slightly larger diameter than the upper tubular member 14 as shown in FIGS. 1, 3, and 5. This as noted allows for lateral movement as well as vertical movement of the platform 12 on which the user stands during use. With the lower tubular member 16 larger when the user compresses the sidewall formed of the two tubular members 14 and 16, the vertical movement tends to rotate the upper tubular member 14 toward the center axis of the device 10 thereby providing means for stability. The larger diameter lower tubular member 16 also provides a larger footprint on the floor or support surface to as noted earlier prevent slippage. This is enhanced with means for frictional engagement to the support surface by a plurality of ridges 24 extending from the bottom surface of the lower tubular member 16 helping maintain engagement on the floor or support surface, even if wet.

Both the tubular members forming a sidewall for the elevated platform 12, have interior cavities 26 which are sealed and may be air-filled to maintain their shape and to provide resilience to the formed sidewall. The employment of two such tubular members allows for inflation of each at different inflation levels and thus different resilience levels which provides a means to adjust the resilience of the formed sidewall to adjust the horizontal and vertical stability of the platform 12.

Also shown in FIG. 4 is a view of the means of engagement of a top surface of the lower tubular member 16 to a bottom surface of the upper tubular member 14. Currently, a preferred means of such engagement is tongue and groove 27 engagement between the upper and lower tubular members since it allows for removable engagement of the two and transport of the device in component pieces. However because the two tubular members 14 and 16 are collapsible if their interior cavities 26 are de-pressurized, the two tubular members might be extruded as a single unit with a permanent connection or employ other means for permanent connection between the two.

Also in a preferred mode of the device 10 there is shown FIG. 5 and FIG. 1, a plurality of mounts 28 for elastic or resistance band exercise device devices. The mount 28 has a gap underneath to allow for the resistance band to encircle the mount 28 such that a user may stand on the platform 12 and use the resistance band exerciser and concurrently receive the benefits from the device 10 of shock absorption while concurrently enhancing the exercise with proprioception exercise since the platform 12 will move both vertically and horizontally relative to the actions of the user.

Adjacent to the mount 28 are air vents 30 which are positioned below the outside edge of the platform support 13 to direct air vented from the interior of the device 10 downward and away from the user to avoid chilling the user or blowing dust or particulate into their eyes which might be on the floor. Also on the top are shown handles 32.

A second means to alter the stability of the platform 12 is provided by the pressurized air or gas employed to fill the tubular members 16 and 14. Since the tubular members 14 and 16 will be either harder or softer depending on internal pressure, they will react with different compression rates and roll rates toward the center axis of the device 10 when the user shifts their weight, depending on the internal pressure. By inflating one tubular member more than the other, unique unstable configurations can be achieved for balance practice.

As noted, the device 10 may be employed as a step exercise platform or a balance exercise platform for proprioception enhancement. When employed as a step exercise platform, a reduction in height may be desirable of the platform 12, for example, by employing only the upper tubular member 14 engaged with the platform 12. However, the most cushioning and utility is provided when the sidewall supporting the platform 12 is formed by a plurality of tubular members 14 and 16 engaged along a seam therebetween.

The device 10 may also be employed as a game, by placing a plurality of the devices 10 similarly configured, adjacent to each other. Adjacent players supported by adjacent devices 10 would thereafter try and dislodge their fellow game players from their respective platforms 12 using hands or padded members and other instruments to prod adjacent players.

While all of the fundamental characteristics and features of the balance and exercise device have been disclosed and described, with reference to particular embodiments thereof, a latitude of modification, various changes and substitutions are intended in the foregoing disclosure and it will be apparent that in some instance, some features of the invention will be employed without a corresponding use of other features without departing from the scope of the invention as set forth. It should be understood that such substitutions, modifications, and variations may be made by those skilled in the art without departing from the spirit or scope of the invention. Consequently, all such modifications and variations are included within the scope of the invention as defined herein.

What is claimed is:

1. An exercise apparatus comprising:

a substantially rigid platform;

a substantially circular sidewall formed of an inflatable first tubular member stacked upon an inflatable second tubular member situated upon a support surface, said sidewall having an upper surface and a lower surface;

means for engagement of a bottom surface area of said first tubular member to a top surface area of said second tubular member;

said sidewall having a central aperture defined by said sidewall;

means for engagement of said platform over said central aperture in an engaged position adjacent to said upper surface of said sidewall;

said sidewall providing an elevated support for said platform above said support surface, said elevated support having a resilience;

said lower surface of said sidewall adapted for placement of said sidewall upon said support surface;

said resilience providing both a vertical and horizontal instability to said platform;

said first tubular member inflatable to a first pressure level and said second tubular member independently inflatable to a second pressure level wherein one of said first pressure level and said second pressure level can be varied to adjust said resilience and thereby vary said vertical and horizontal instability.

2. The exercise apparatus of claim 1 wherein said vertical and horizontal instability of said platform provides for proprioceptive input training.

3. The exercise apparatus of claim 1 additionally comprising:

a plurality of projections extending from said lower surface of said sidewall of said sidewall for enhanced frictional engagement to said support surface.

4. The exercise apparatus of claim 2 additionally comprising:

a plurality of projections extending from said lower surface of said sidewall of said sidewall for enhanced frictional engagement to said support surface.

5. The exercise apparatus of claim 1, said means for engagement of a bottom surface area of said first tubular member to a top surface of said second tubular member comprising a tongue and groove engagement formed of a projection extending from one of said top surface of said second tubular member and said bottom surface of said first tubular member engaged into a groove formed in the other of said top surface of said second tubular member and said bottom surface of said first tubular member.

6. The exercise apparatus of claim 1, said means for engagement of said platform over said central aperture comprising:

an annular ring extending from an inner surface of said sidewall surrounding said central aperture adjacent to said upper surface; and means to engage said platform to said annular ring.

7. The exercise apparatus of claim 1 wherein:

said second tubular member has a larger outside diameter than said first tubular member stacked thereupon; and said platform has a mount for an elastic exercise band.

8. An exercise apparatus comprising:

a substantially rigid platform;

a substantially circular sidewall comprising a first tubular member and a second tubular member, said sidewall comprising an upper surface, a lower surface, and a central aperture defined by said sidewall;

said first tubular member comprising means for engaging a bottom surface area of said first tubular member to a top surface area of said second tubular member and means for engaging said platform over said central aperture;

said sidewall provides a resilient, elevated support for said platform above a support surface to provide said platform with a vertical and horizontal instability that is adjustable by inflating said first tubular member to a first pressure level and inflating said second tubular member to a second pressure level independently from said first pressure level.

9. The exercise apparatus of claim 8 further comprising a plurality of projections extending from said lower surface of said sidewall for frictionally engaging said support surface.

10. The exercise apparatus of claim 8, said means for engaging a bottom surface area of said first tubular member to a top surface area of said second tubular member comprising:

a projection extending from one of said top surface of said second tubular member and said bottom surface of said first tubular member; and a groove formed in the other of said top surface of said second tubular member and said bottom surface of said first tubular member for engaging the projection.

11. The exercise apparatus of claim 8, said means for engaging said platform over said central aperture comprising an annular ring extending from an inner surface of said sidewall surrounding said central aperture.

12. The exercise apparatus of claim 8, said second tubular member comprising an outside diameter that is greater than an outside diameter of said first tubular member.

13. The exercise apparatus of claim 8, said platform comprising a mount for an elastic exercise band.

* * * * *

UNITED STATES PATENT AND TRADEMARK OFFICE

CERTIFICATE OF CORRECTION

PATENT NO. : 7,722,506 B2
APPLICATION NO. : 12/075322
DATED : May 25, 2010
INVENTOR(S) : David C. Pratson et al.

It is certified that error appears in the above-identified patent and that said Letters Patent is hereby corrected as shown below:

In the "References Cited", add U.S. Patent No. 3,125,377 issued on 3/1964 to Bridges; delete "U.S. Patent No. 3,761,083 issued on 9/1973 to Buchner et al.".

In Claim 3, column 9, line 34 of the Patent, delete "of said sidewall" before "enhanced" and insert --of said sidewall-- after "engagement".

In Claim 4, column 9, line 40 of the Patent, delete "of said sidewall" before "enhanced" and insert --of said sidewall-- after "engagement".

Signed and Sealed this

Thirteenth Day of July, 2010

David J. Kappos

David J. Kappos
*Director of the United States Patent and Trademark Office*